US006238055B1

(12) United States Patent
Wallace

(10) Patent No.: US 6,238,055 B1
(45) Date of Patent: May 29, 2001

(54) POWERED LIGHTING FOR IN-LINE SKATES, ROLLERSKATES, ICE SKATES, AND FOR WALKING OR JOGGING

(76) Inventor: Christopher T. Wallace, 2025 NE. 2nd Ter., Cape Coral, FL (US) 33909

( * ) Notice: Subject to any disclaimer, the term of this patent is extended or adjusted under 35 U.S.C. 154(b) by 0 days.

(21) Appl. No.: 09/370,237

(22) Filed: Aug. 9, 1999

Related U.S. Application Data

(60) Provisional application No. 60/095,870, filed on Aug. 10, 1998, provisional application No. 60/025,261, filed on Sep. 17, 1996, and provisional application No. 60/004,363, filed on Sep. 27, 1995.

(51) Int. Cl.[7] ..... F21V 21/08

(52) U.S. Cl. ..... 362/103; 280/11.19

(58) Field of Search ..... 362/103, 459; 280/11.19, 11.203, 11.22

(56) References Cited

U.S. PATENT DOCUMENTS

| | | | | |
|---|---|---|---|---|
| 4,794,496 | * | 12/1988 | Lanes | 362/105 |
| 5,255,167 | * | 10/1993 | Toussaint | 362/103 |
| 5,588,734 | * | 12/1996 | Talamo | 362/459 |
| 5,855,382 | * | 1/1999 | Reilly | 280/11.19 |

* cited by examiner

*Primary Examiner*—Sandra O'Shea
*Assistant Examiner*—Hargobind S. Sawhney
(74) *Attorney, Agent, or Firm*—Frank A. Lukasik

(57) ABSTRACT

The invention is a powered lighting device for in-line skates and other sports equipment. A battery case holding two "AA" batteries is attached around the ankle of an in-line skate. A flexible tube is attached to the battery case at one end and at the second end a socket having a bulb covered by plastic spiral tubes is mounted. The socket is affixed to the skate shoe with a portion of hook and loop material.

2 Claims, 3 Drawing Sheets

POWERED LIGHTING FOR IN-LINE SKATES, ROLLERSKATES, ICE SKATES, AND FOR WALKING OR JOGGING

This is a Continuation of Provisional Application Ser. Nos.: 60/004,363, Filed Sep. 27, 1995; 60/025,261, Filed Sep. 17, 1996; and 60/095,870, Filed Aug. 10, 1998.

BACKGROUND OF THE INVENTION

Field of the Invention

The invention relates generally to a novelty item, and more specifically, the invention relates to a powered lighting device for attachment to the sides of various types of sports equipment.

Skating has developed into a popular hobby and a prosperous profession. Numerous individuals use roller skating and ice skating as a means of exercise, entertainment, and enjoyment. To enhance the visual imagery created by skating, it has hitherto been proposed to illuminate skates by means of small electric light bulbs arranged to produce desired lighting effects. The illuminating devices which have been proposed have been either permanently attached to the skates or have required structural changes in the skates.

Various devices have also been proposed to illuminate other items such as shoe heels and soles, headbands and gloves. U.S. Pat. No. 2,056,126 to broach discloses a bracket assembly for illuminating shoe skates, such as roller skates or ice skates, the bracket assembly comprising one or more bracket units adapted to be detachably secured to the skate. The bracket units selectively containing fittings for mounting light sources, such as multi-colored miniature light bulbs, a source of electrical current for the light sources, and switch means for selectively actuating and deactuating the light sources.

U.S. Pat. No. 4,970,631 to Marshall discloses a device for holding a miniature, high intensity flashlight along the side of the person's head to direct the beam of light in a path vertically positioned at the line of sight of the individual wearing the device. The device includes an elastic strap with overlapping ends held together with VELCRO™ attachments with a tubular strap through which the body of the flashlight is inserted and held in position on the strap. The rear end of the flashlight is held with VELCRO attachment to a corrugated spring clip against an inclined bearing surface block holding the end of the flashlight away from the person's head and allowing the rear end of the flashlight to be fixed to the bearing surface of that block at any height.

U.S. Pat. No. 5,067,058 to Standley discloses a skateboard having roller trucks attached to the underside of the skateboard deck. The trucks are insulated from the skateboard deck by riser pads of sufficient thickness to receive and house self-contained battery operated lamps. The lamps are positioned to direct light beams from beneath the deck in fore and aft directions. Switch means are operable to turn the lamps on and off.

SUMMARY OF THE INVENTION

The invention consists of a miniature light designed to be attached to the sides of various types of sports equipment. The glow/lights (GLITES™) provide a color around the skates while simultaneously providing a white headlight effect that illuminates ahead of the skates. The glow lights of the invention comprises a battery case for two "AA" batteries, a flexible tube attached to the case with a bulb socket and bulb attached at the opposite end. A slide switch is located on the side of the battery case. The bulb socket has a hook (VELCRO) patch affixed thereto for gripping engagement with a mating loop patch cemented or otherwise affixed to the shoe or other lighted object. A colored, transparent tube is placed over the bulb to shine around the area of the bulb and to focus the light forward.

DETAILED DESCRIPTION OF THE PREFERRED EMBODIMENTS

Figure 1:
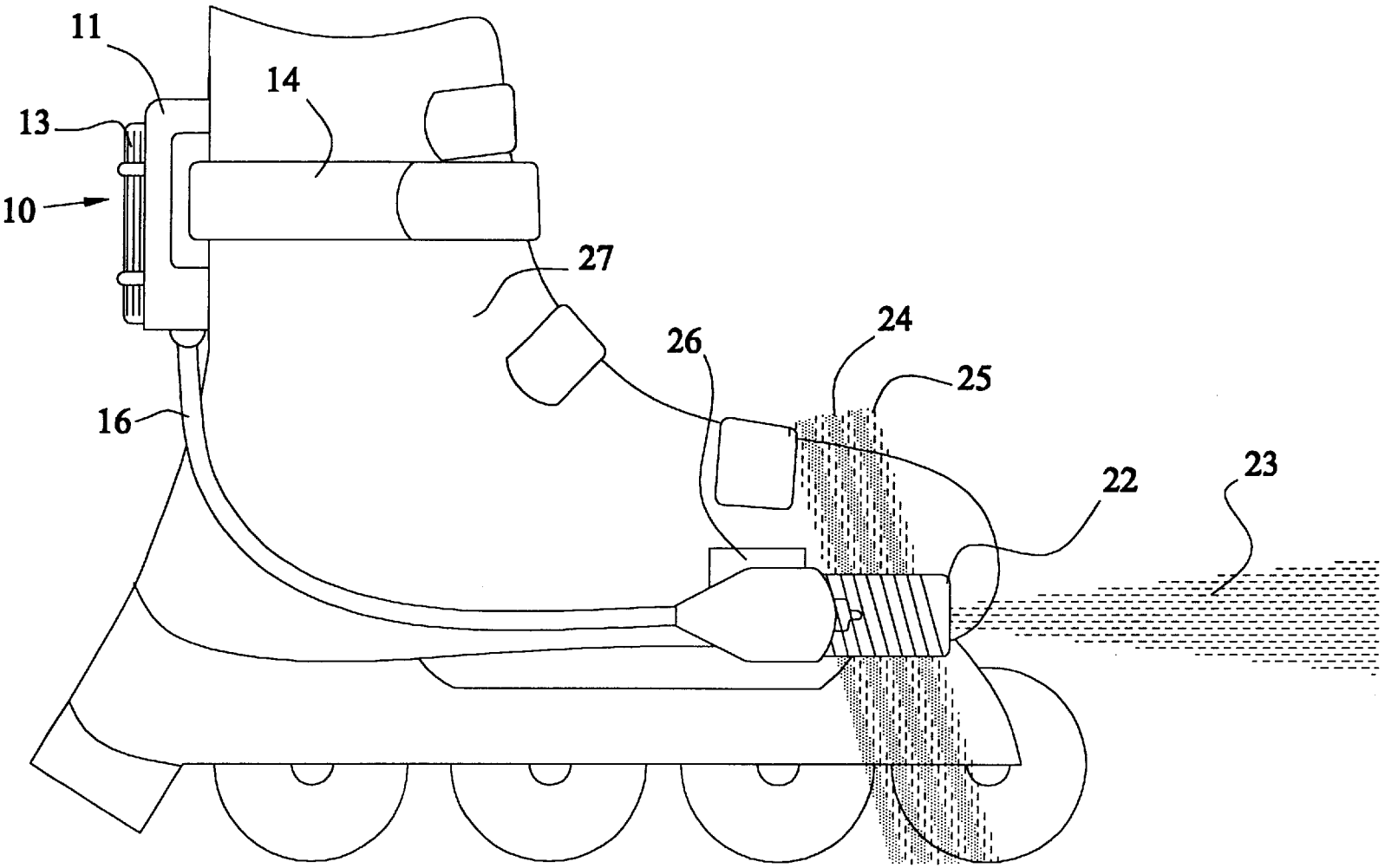
FIG. 1. is a side, view of the invention mounted on an in-line skate in accordance with the invention.
Figure 2:
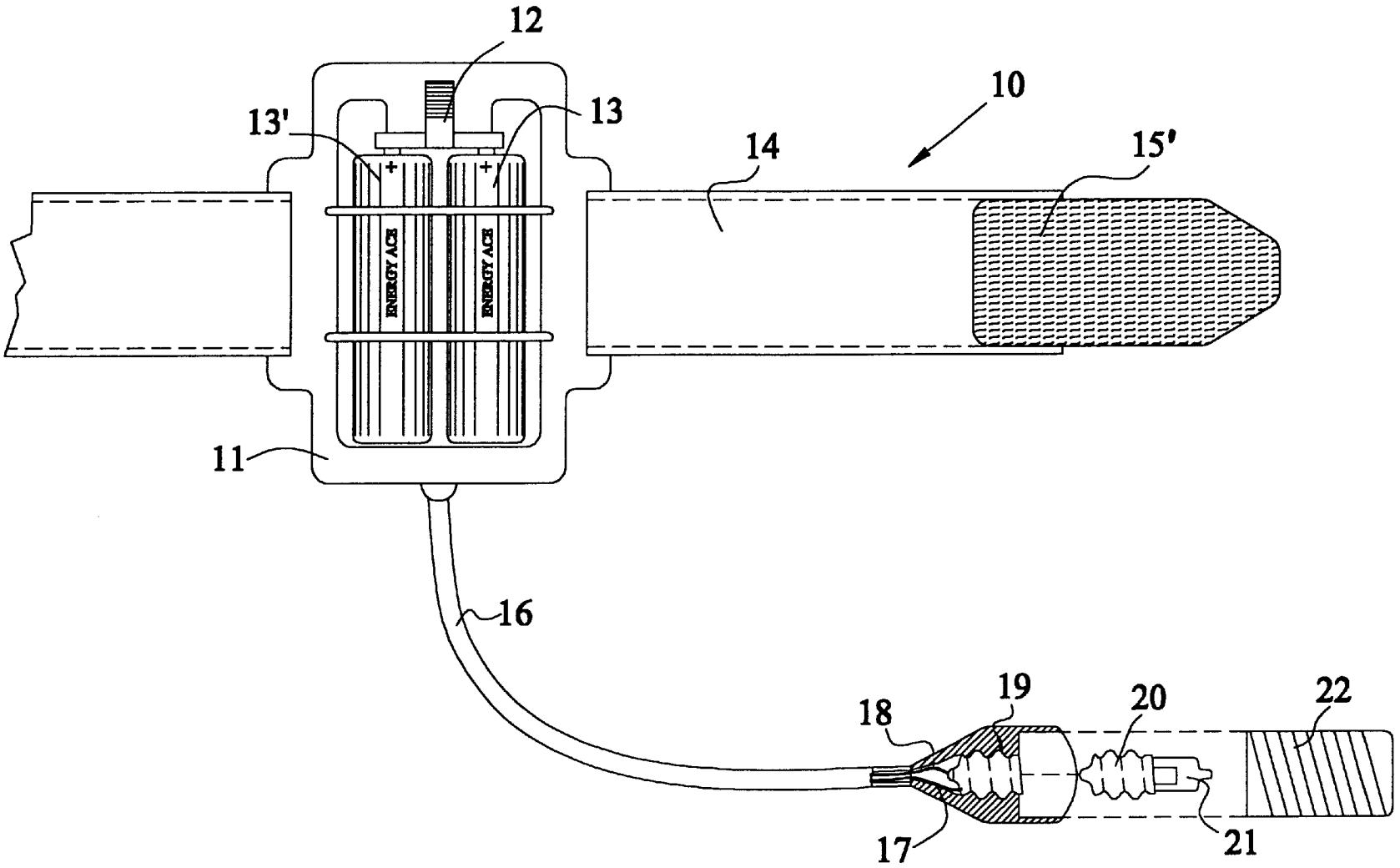
FIG. 2. is an inside view of the invention showing the assembly of the batteries in accordance with the invention.
Figure 3:
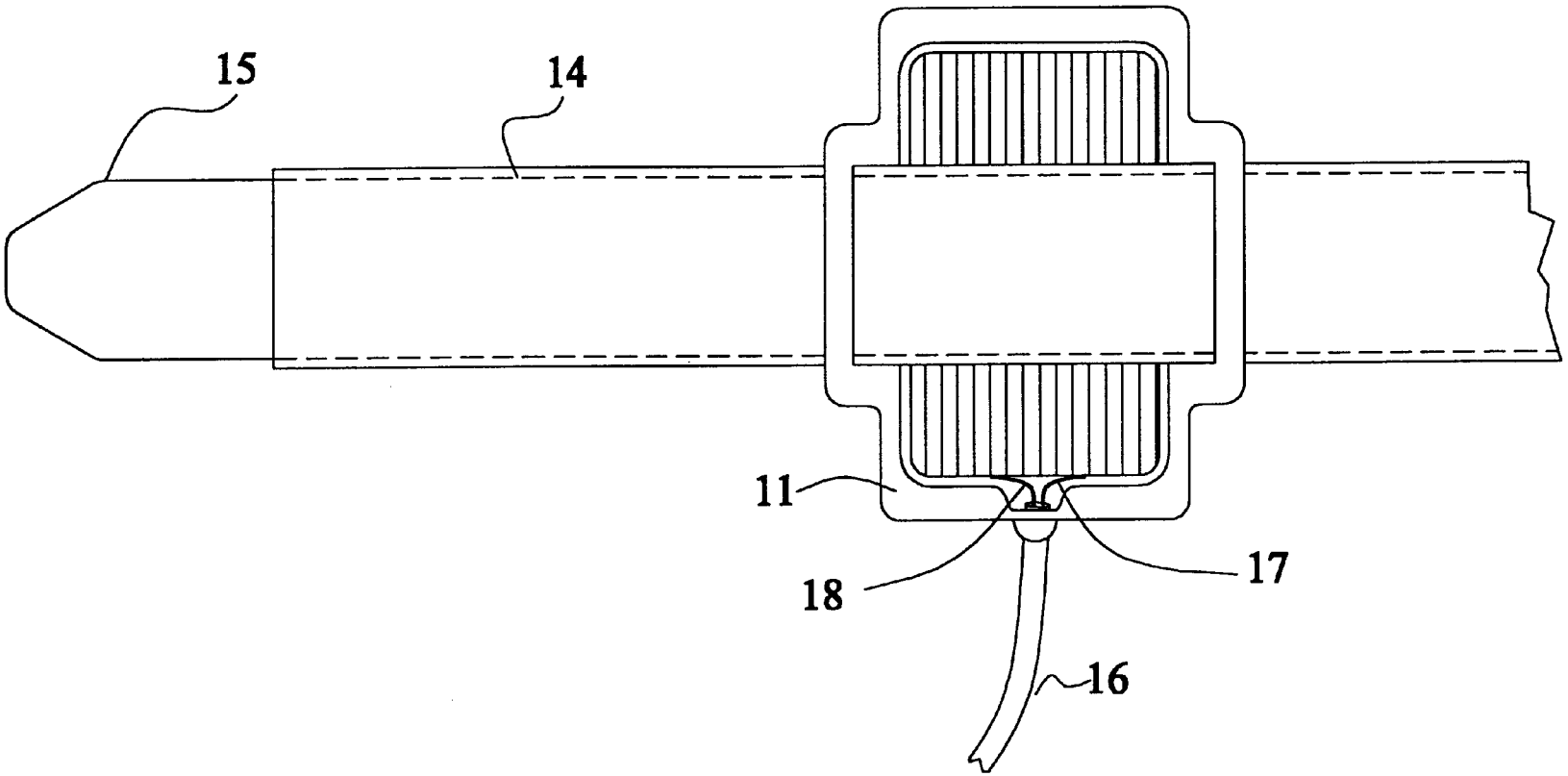
FIG. 3. is an outside view of the invention showing the assembly of the case and the assembly of the battery case and the mounting strap in accordance with the invention.

Referring now to FIG. 1, there is shown a side view of the glow light assembly indicated generally by the numeral 10. The glow light assembly 10, is shown mounted on an in-line skate 27 in accordance with the invention. The glow light assembly 10 comprises a battery case 11 to hold the battery pack 13 and 13'. In a preferred embodiment, the battery pack 13 and 13' consisted of two "AA" batteries mounted in the battery case 11 which measured 1¾ "W ×3"L ×1"D. A slide switch 12 is located on the top of the battery pack 13 and 13'. An elastic band 14 of loop material is inserted in the battery case. A hook material 15, is fastened to one end of band 14. The elastic band 14 is wrapped around the ankle part of the skate 27 and attaches to itself with the hook material 15.

The battery pack 13 and 13' may be removed from the battery case 11 by pulling the elastic band 14 from the center of the battery pack 13 and 13', approximately 2–3 inches away, then turn and lift the switch 12 to pull away the battery pack 13 and 13'out of the case 11. There are two wires 17 that run inside flexible tubing 16 from the battery pack 13 and 13' to the socket 19 (bulb holder). A vinyl boot 18 covers the socket 19 and holds the transparent, colored, spiral tubes 22 in place. Spiral glow tube 22 shown in FIG. 1, provides a color glow 24 and 25 (ground effect) around tube 22 and on one side of the skate shoe 27 while . . . ahead of the skate shoe 27, in a preferred embodiment, the flexible tube had a ¼ " diameter with two wires (+ and –) and the bulb 21 was a 2.33 volt, 0.27 amp, pre-focused bulb.

As shown in FIG. 1, the vinyl boot 18 and spiral tubes 22 are affixed to the skate shoe 27 with a hook and loop strip 26, with the adhesive backed loop section fastened to the skate shoe 27 and the loop section fastened to the vinyl boot 18. The user may fasten the loop strip on the boot or blade allowing the user to personalize his/her ground effect.

Thus it will be appreciated that the present invention provides a novelty device consisting of a glow light which can be mounted on any style skate, or walking or jogging shoe or other sports equipment. It is contemplated that other embodiments and/or modifications may be made in the present invention without departure from inventive concepts manifested by the disclosed embodiments. It is expressly intended, therefore, that the foregoing description is illustrative only of preferred embodiments, not limiting, and that the true spirit and scope of the invention be determined by reference to the appended claims.

What is claimed is:

1. A powered lighting device removably attached to in-line skate shoes and other sports equipment, said lighting device consisting of:

a battery case, said battery case having a pair of batteries mounted therein and a battery switch for controlling the operation of said batteries, an elastic band of loop material having a first end being inserted through said battery case, said elastic band first end having a portion of hook material fastened thereon for mating with said loop end when mounting said powered lighting device on said equipment and for holding said pair of batteries within said battery case, a flexible tube having a first end and a second end, said first end being attached to said battery case, said flexible tube having a pair of wires therein, a bulb socket being attached to said flexible tube second end, said bulb socket being covered with a vinyl boot and having a pre-focused bulb, and plastic spiral tubes mounted therein, said spiral tubes surrounding said bulb generating ground effect lighting on one side of the skate shoe and a headlight effect lighting, and a portion of hook and loop material, with said hook material being fastened to said vinyl boot and said loop material being fastened on a desired position on said skate shoe.

2. The powered lighting device of claim 1 wherein said batteries consist of two "A" batteries, said spiral tubes being transparent, and colored, and said bulb consists of a 2.33 volt, 0.27 amp, pre-focused bulb.

* * * * *